United States Patent [19]

Greenwood

[11] 4,138,031

[45] Feb. 6, 1979

[54] NON-CORROSIVE LIFTING LUG FOR TANKS

[75] Inventor: Mark E. Greenwood, Conroe, Tex.

[73] Assignee: Owens-Corning Fiberglas Corporation, Toledo, Ohio

[21] Appl. No.: 829,748

[22] Filed: Sep. 1, 1977

[51] Int. Cl.[2] ..... B65D 25/22

[52] U.S. Cl. ..... 220/71; 220/85 D; 294/67 D; 428/114

[58] Field of Search ..... D8/316, 371; 16/110 R; 220/3, 71, 85 R, 85 D, 94 R; 224/45 P, 55; 248/220.2, 225.2, 359–360; 294/67 D; 428/114

[56] References Cited

U.S. PATENT DOCUMENTS

| | | | |
|---|---|---|---|
| 2,758,951 | 8/1956 | Case | 428/114 |
| 3,073,493 | 1/1963 | Pfaffenberger | 220/94 R |
| 3,680,727 | 8/1972 | Pearson | 220/3 |

*Primary Examiner*—Steven E. Lipman

*Attorney, Agent, or Firm*—Ronald C. Hudgens; Patrick P. Pacella; Paul J. Rose

[57] ABSTRACT

Two generally flat, spaced U-shaped portions of the lug generally parallel to a first reference plane and each having a bight portion connecting a pair of straight parallel spaced leg portions are joined at the free end portions of their leg portions by two generally flat, spaced straight lug portions parallel to each other and to a second reference plane perpendicular to the first. The lug is formed of a continuously wound resin-impregnated strand of glass filaments. Several such lifting lugs are secured to a tank by resin-impregnated glass filaments wound therearound.

2 Claims, 5 Drawing Figures

NON-CORROSIVE LIFTING LUG FOR TANKS

This invention relates generally to lifting lugs for tanks, and more particularly to a non-corrosive lifting lug of resin reinforced with a continuously wound strand of glass filaments.

Prior to my invention, non-corrosive plastic tanks were generally provided with steel lifting lugs. Frequently the steel lugs became corroded and had to be replaced at considerable expense. In accordance with my invention, non-corrosive lifting lugs are now provided on non-corrosive tanks, these non-corrosive lugs being more durable and at least as strong as the former steel lugs.

An object of the invention is to provide non-corrosive lifting lugs for tanks.

Another object is to provide a lifting lug of resin reinforced with a continuously wound strand of glass filaments.

Other objects and advantages will become apparent when the following specification is considered along with the accompanying drawings in which.

Figure 1:
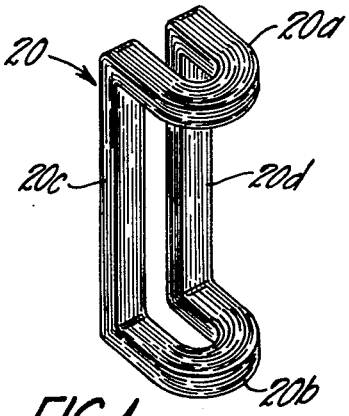
FIG. 1 is a perspective view of a lifting lug constructed in accordance with the invention.
Figure 5:
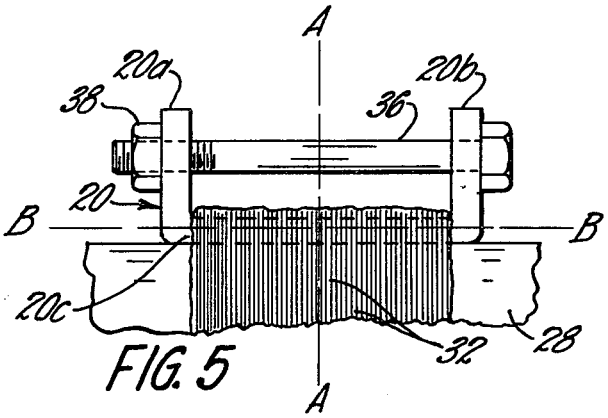
FIG. 5 is a fragmentary enlarged view of the tank of FIGS. 2 to 4 showing one of the lifting lugs of the invention with a nut and bolt mounted therein for a lifting operation on the tank.

With respect to the drawings, FIG. 1 shows a lifting lug 20 constructed in accordance with the invention and including a pair of generally flat, spaced U-shaped lug portions 20*a* and 20*b*, generally parallel to a first reference plane represented by the vertical line A—A in FIG. 5 and each having a bight portion connecting a pair of straight parallel spaced leg portions, joined at the free end portions of their leg portions by a pair of generally flat, spaced straight lug portions 20*c* and 20*d* parallel to each other and to a second reference plane perpendicular to the first and represented by the horizontal line B—B in FIG. 5. The lifting lug 20 is formed by hand winding a continuous resin-impregnated strand of glass filaments repeatedly on an appropriately shaped composite separable form disclosed in the copending application of William A. Schneider, assigned to the assignee of the instant application, Ser. No. 829,747, filed Sept. 1, 1977.

Figure 2:
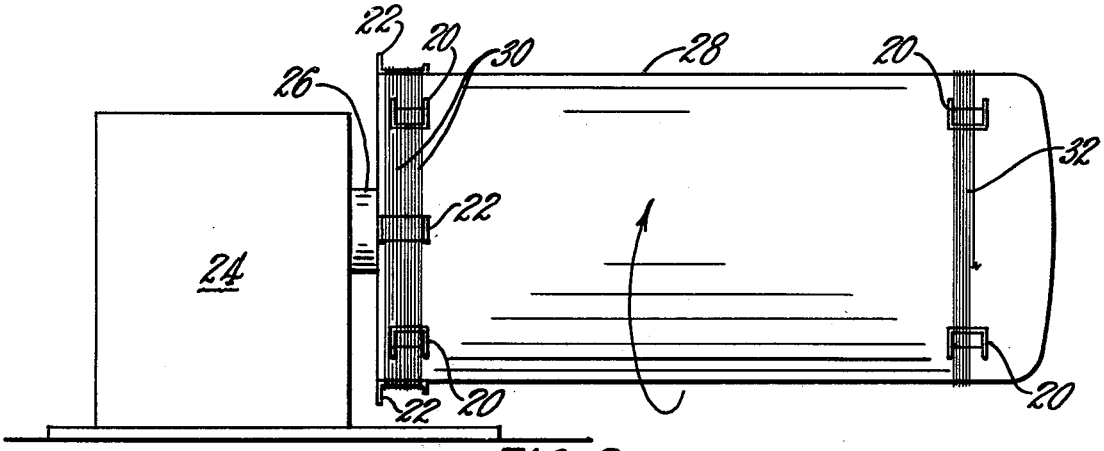
FIG. 2 is a schematic elevational view of a mandrel and a tank formed thereon, showing how lifting lugs of the invention may be attached to the tank.

FIG. 2 shows a housing 24 which supports a rotatably driven mandrel 26 on which a tank 28 of glass fiber reinforced thermosetting resin is produced. At least one of the lifting lugs 20 is secured to the tank 28 adjacent the bottom thereof by windings of a continuous resin-impregnated strand 30 of glass filaments applied before the tank 28 is fully cured. Upon final curing, the strand 30 becomes an integral part of the tank 28 and the lifting lug or lugs 20 are securely fastened in place. Several hold-down lugs 22 are also secured to the tank 28 adjacent the bottom by the windings of the strand 30. The hold-down lugs 22 are the subject of my copending application, Ser. No. 829,743, filed Sept. 1, 1977. Several lifting lugs 20 are secured to the tank 28 adjacent the top thereof by windings of another continuous resin-impregnated strand 32 of glass filaments, at least one of the top lugs 20 being aligned with the bottom lug 20 axially of the tank 28.

Figure 3:
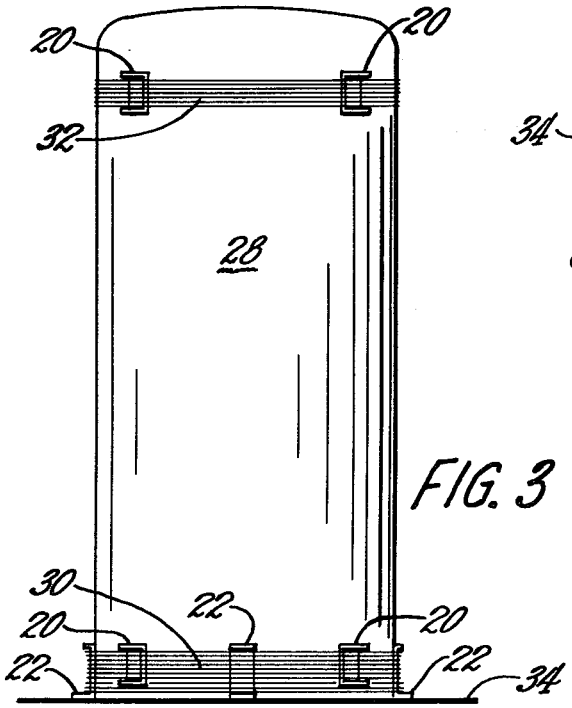
FIG. 3 is an elevational view of an installed tank having lifting lugs of the invention.
Figure 4:
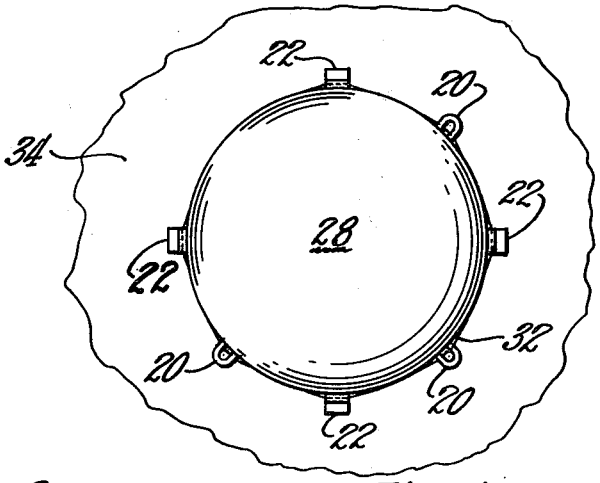
FIG. 4 is a plan view of the tank of FIG. 3.

FIGS. 3 and 4 show the tank 28 mounted on a supporting surface 34.

FIG. 5 shows a bolt 36 mounted in one of the lifting lugs 20 and secured in place by a nut 38. A cable or hook (not shown) disposed around the bolt 36 enables the tank 28 to be lifted.

I claim:

1. A non-corrosive lifting lug for tanks, the lug comprising a pair of generally flat, spaced U-shaped lug portions generally parallel to a first reference plane and each having a bight portion connecting a pair of straight parallel spaced leg portions, and a pair of generally flat, spaced straight lug portions joining free end portions of the leg portions of the U-shaped lug portions, the straight lug portions being generally parallel to each other and to a second reference plane perpendicular to the first, each straight lug portion joining a free end portion of one of the leg portions of one of the U-shaped lug portions with a free end portion of a corresponding leg portion of the other of the U-shaped lug portions, and the lug being formed of resin reinforced with a continuous reinforcing strand extending repeatedly through the straight lug portions longitudinally thereof and the U-shaped lug portions in the U-shape thereof.

2. A lifting lug as claimed in claim 1 wherein the reinforcing strand comprises glass filaments.

* * * * *